US012421819B2

(12) United States Patent
Sarian

(10) Patent No.: US 12,421,819 B2
(45) Date of Patent: Sep. 23, 2025

(54) CABLE DEPLOYED ELECTRICAL SUBMERSIBLE PUMP JARRING TOOL AND METHOD

(71) Applicant: Alkhorayef Petroleum Company, Dammam (SA)

(72) Inventor: Serko Sarian, Dammam (SA)

(73) Assignee: Alkhorayef Petroleum Company (SA)

( * ) Notice: Subject to any disclaimer, the term of this patent is extended or adjusted under 35 U.S.C. 154(b) by 0 days.

(21) Appl. No.: 18/407,618

(22) Filed: Jan. 9, 2024

(65) Prior Publication Data

US 2025/0223883 A1 Jul. 10, 2025

(51) Int. Cl.
*E21B 23/14* (2006.01)
*E21B 17/02* (2006.01)
*E21B 43/12* (2006.01)

(52) U.S. Cl.
CPC ..... *E21B 23/14* (2013.01); *E21B 17/028* (2013.01); *E21B 43/128* (2013.01)

(58) Field of Classification Search
CPC ..... E21B 23/14; E21B 17/028; E21B 43/128
See application file for complete search history.

(56) References Cited

U.S. PATENT DOCUMENTS 3,342,266 A * 9/1967 Le Blanc ..... E21B 31/00 166/243
6,109,373 A * 8/2000 Able ..... E21B 31/18 166/178
2010/0258314 A1* 10/2010 Rose ..... E21B 31/107 166/301

* cited by examiner

*Primary Examiner* — Dany E Akakpo
(74) *Attorney, Agent, or Firm* — Eschweiler & Potashnik, LLC

(57) ABSTRACT

Improved installation speed and reliability for electrical submersible pumps may be realized through the system and methods disclosed herein. An adjustable jarring device is used to break a release pin, the force of the jarring device can be adjusted based on its height above the pin. In another aspect, the jarring device comprises a secondary weight configured to provide a second at break the shear pin of a tool without requiring resetting it. Another aspect is a tool catcher device that allows for catching and holding the jarring device and dropping it, as well as retrieval of the tool in the event the cable is disconnected.

19 Claims, 12 Drawing Sheets

CABLE DEPLOYED ELECTRICAL SUBMERSIBLE PUMP JARRING TOOL AND METHOD

FIELD

The technology disclosed herein relates to a jarring tool for a submersible pump, in particular for a submersible pump for use in a wellbore.

BACKGROUND

Electrical submersible pump (ESP) systems are a type of artificial lift system used in oil and gas wells to increase the flow of fluids (such as water and/or oil) to the surface. An ESP generally includes a pump that is submerged in the wellbore and is powered by a downhole electric motor. The ESP system is designed to operate under high temperatures, pressures, and corrosive conditions, making it suitable for use in harsh downhole environments.

ESPs may be installed in a wellbore with a landing assembly to improve production. An ESP is electrically connected to an external power source at the top of the wellbore via an electrical power cable. Near the top of the wellbore on the spool there are a set of electrical connectors configured to contact electrical connectors at the ESP cable hanger leading to an external power source. These electrical connectors should be lined up with a matching set of electrical connectors on the outer ring of the surface spool situated below the Christmas tree.

Installing, replacing, or repairing an ESP requires significant time and cost in preparing the wellbore to perform the installation or change out operation, lasting days and even weeks at times. Among the many operations needed are "killing the well," consisting of pumping heavy fluids in the well to prevent uncontrolled well fluids spill at surface, and the spudding of a workover rig to remove the complete production assembly at the end of which the ESP is connected. Often the preparation for servicing the ESP or removing the landing equipment involves even more time than the time to replace or repair the ESP. Landing assembly equipment and personnel time is also valuable, so a fast and accurate system and method for installing, electrically connecting the ESP, and releasing the landing equipment is desirable.

SUMMARY

The following is a brief summary of subject matter that is described in greater detail herein. This summary is not intended to be limiting as to the scope of the claims.

Improvements in ESP installation speed and reliability may be realized without the use of a workover rig or the need to kill the well. Further improvements can be achieved by using the power cable itself to deploy and retrieve the ESP in the well. An exemplary operation entails the use of an adjustable jarring device to release the ESP and power landing equipment from the power cable surface end by breaking a release pin. The force of the jarring device can be adjusted based on its height above the pin. In another aspect, the jarring device comprises a secondary weight configured to insure the release pin breaks in the event that the primary jarring device fails to break the pin. Another aspect is a tool catcher device that allows for catching and holding the jarring device and dropping it when needed, as well as catching the ESP in the event the power cable is accidentally disconnected during the deployment operation.

In some aspects, the techniques described herein relate to a jarring device for installing an electrical submersible pump system in a wellbore, including: an upper weight section, the upper weight section including an upper opening and a lower opening centered around an axis, and inner walls defining a housing between the upper and lower openings; and a jar section, the jar section including an upper hole opening and configured to retain a terminal end of a cable in an interior hollow. The upper weight section is configured to slide in relation to the cable and in relation to the jar section.

In some aspects, the techniques described herein relate to a method of installing an electrical submersible pump system in a wellbore, the method including: installing a jarring device on a cable above the wellbore, the jarring device including an upper weight section and a jar section; catching the upper weight section and suspending it a drop distance from a top of the jar section, the drop distance being between a bottom of the upper weight section and a top of the jar section; dropping the upper weight section; and ramming a bottom of the upper weight section into a top surface of the jar section with an impact force; wherein the impact force resulting from the ramming of the upper weight section is transferred to a primary shear pin in a tool below.

In some aspects, the techniques described herein relate to a system for installing an electrical submersible pump in a wellbore with a cable. The system includes a tool catcher positioned above the wellbore; a jarring device including: an upper weight section, the upper weight section including an upper opening and a lower opening centered around an axis, and inner walls defining a housing between the upper and lower openings; and a jar section, the jar section including an upper hole opening and configured to retain a terminal end of the cable in an interior hollow; the upper weight section is configured to slide in relation to the cable and in relation to the jar section; a hanger positioned below the jarring device; a spool retaining the hanger; an electrical submersible pump disposed in a wellbore electrically coupled to the hanger via a downhole cable section. The hanger is electrically coupled to electrical connections in the spool.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

Figure 1:
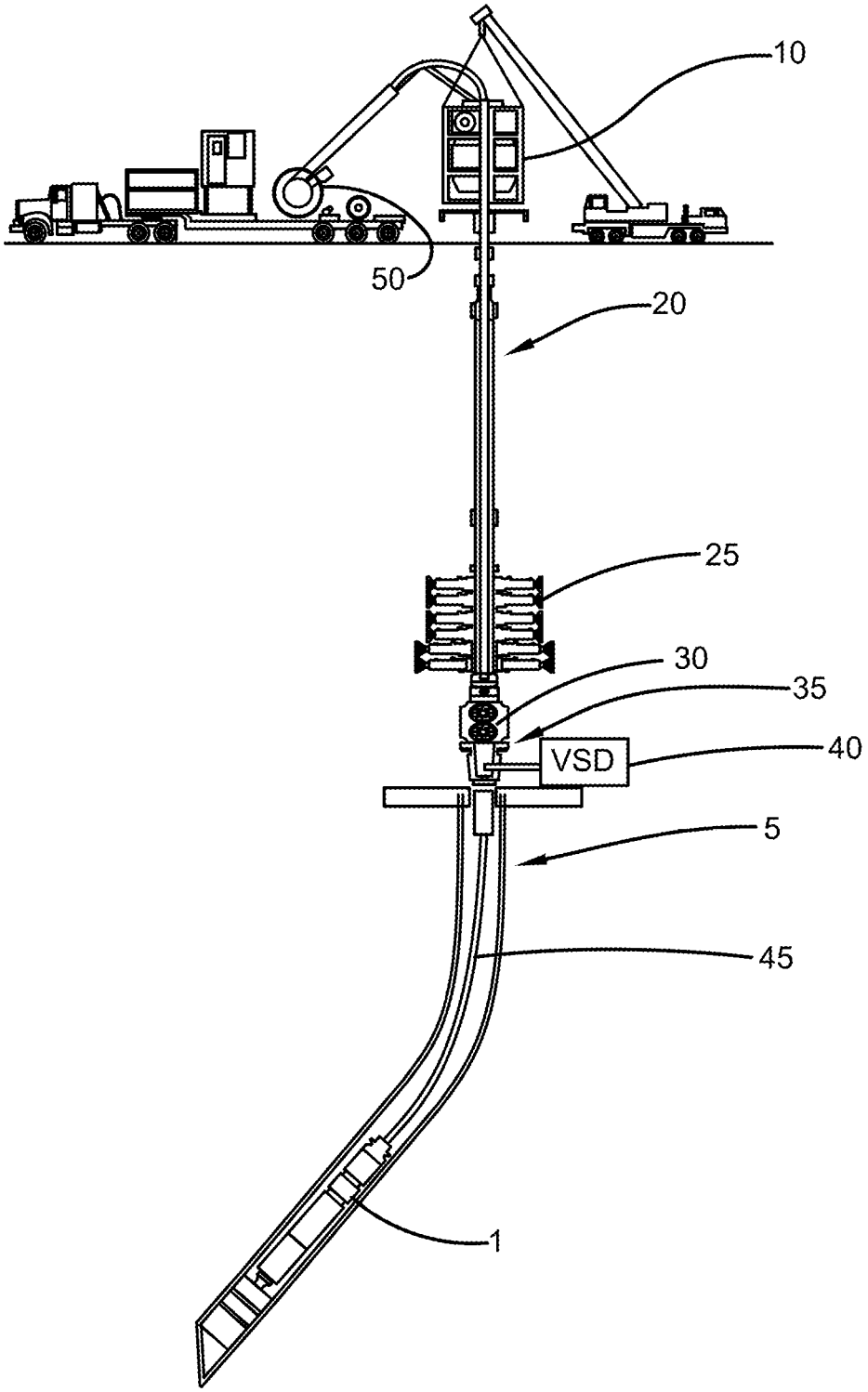
FIG. 1 is a side plan view of an exemplary system for installing a cable deployed ESP system.

It should be noted that the drawings are not to scale.

DETAILED DESCRIPTION

Various technologies pertaining to electrical submersible pumps (ESPs) and landing and release mechanisms for the same are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details. In other instances, well-known structures and devices are shown in block diagram form in order to facilitate describing one or more aspects. Further, it is to be understood that functionality that is described as being carried out by certain system components may be performed by multiple components. Similarly, for instance, a component may be configured to perform functionality that is described as being carried out by multiple components.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Additionally, as used herein, the term "exemplary" is intended to mean serving as an illustration or example of something, and is not intended to indicate a preference. In addition, the terms "inner" and "outer" are in reference to the longest axis of the devices and systems disclosed herein. The term "fluidly coupled" means a fluid, such as oil, can flow through from one end of the area it relates to, to another. For example, X is fluidly coupled to Y, means fluid can flow through tubing or some channel or chamber from X to Y or vice versa.

OVERVIEW

With reference to FIG. 1, an exemplary cable-deployed ESP system in a wellbore 5 with landing equipment is depicted in a schematic view. The ESP 1 is already deployed into the wellbore 5 adjacent to a pre-installed packer 15. In this example a crane hoists a pressure control equipment 10 above the wellbore 5. One or more risers 20 is coupled to the pressure control equipment 10. Inside the risers 20 are additional components of the technology disclosed more fully in FIGS. 6 to 10E. The risers 20 are connected to a blow-out preventer (BOP) which is coupled to a Christmas tree unit 30. The Christmas tree unit 30 is coupled to hanger and spool components 35, which are shown in more detail in FIG. 5. A variable speed drive (VSD) 40 is coupled to the wellbore 5 for pumping fluid from the well.

The ESP 1 is coupled to a cable 45 that runs through the wellbore 5, through the hanger and spool components 35, the Christmas tree unit 30, the risers 20 and the pressure control equipment 10 to a reel 50. The reel 50 contains the coiled cable 45. In operation the cable can be advanced (downhole) or retracted (uphole) by a feeding mechanism. In this example, the feeding mechanism (the injector head) is a set of conveyor belts that contact two sides of the cable 45 to drive it downhole or uphole.

An electrical power source (not shown) provides power to the VSD 40 and to the ESP 1 via the cable 45. Connections in the hanger and spool components 35 couple the power source to the wiring in the cable 45. The power source may, for example, drive current at 120 Amps at 5000 volts.

In this example, the cable 45 is a heavy-duty hybrid cable that includes a 3-phase electrical core, and is surrounded by load bearing double layered metal armors for protection and heavy-duty load bearing. The load bearing double layer armor stainless steel or other alloy metallurgy. The cable 45 can have an outer diameter, of, for example, 0.5 to 2 inches, such as 1.1 to 1.25 inches, or 1.15 to 1.25 inches. The cable 45 may have a tensile strength of at least 22,500 lbs, e.g., 24,000 to 45,000 lbs, or 28,000 to 35,000 lbs, and may run in lengths of, for example, 2,000 to 15,000 ft, or 5,000 to 10,000 ft, or 7,000 feet.

In ESP wellbore systems that employ heavy duty cabling that includes power cabling inside it for the ESP additional challenges are presented. Sufficiently accelerating down with a coiled tubing injector head unit and jarring the heavy cable with connected apparatus to break the shear pins of the running/pulling tool without damaging the spool or electrical connections is difficult. Examples of the technology disclosed herein is designed to alleviate this difficulty.

Figure 2:
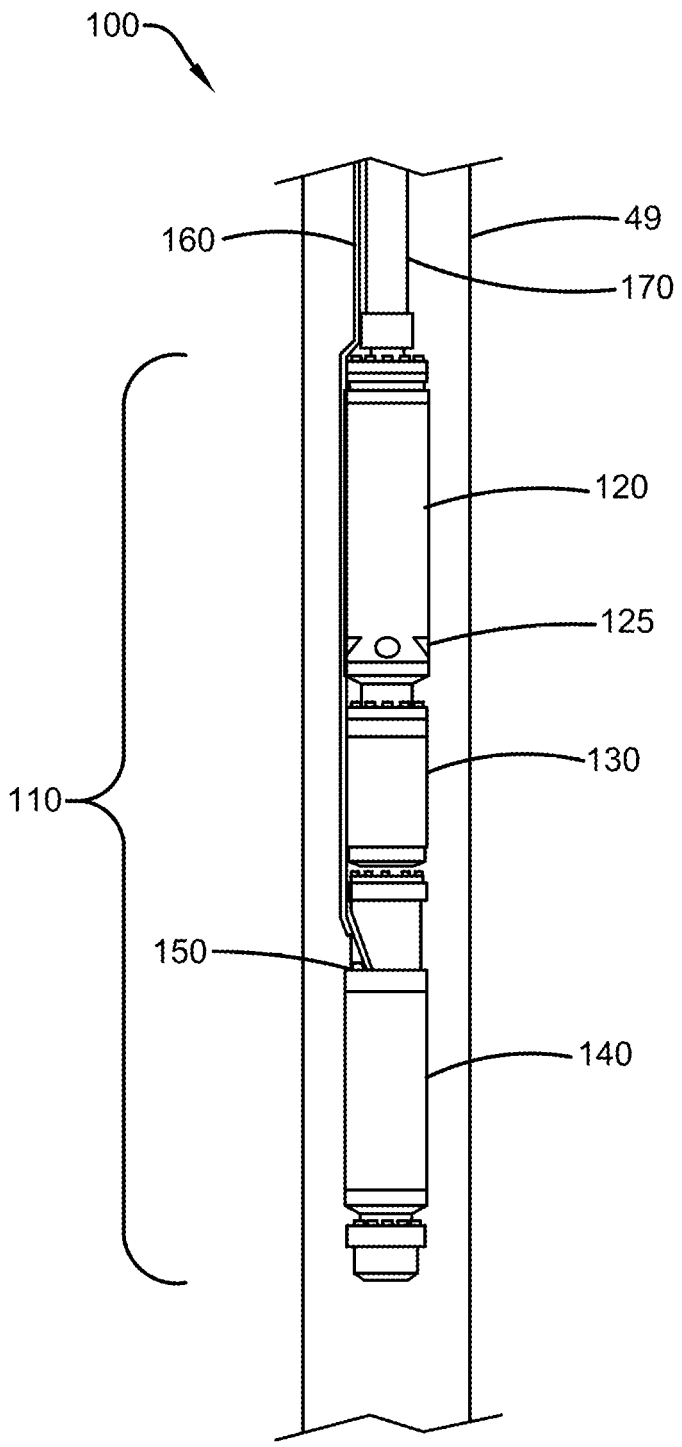
FIG. 2 is a side plan view of an exemplary ESP system in a wellbore deployed at the end of the production tubing.

The ESP is described in more detail in FIG. 2, which shows an exemplary ESP 110 disposed within the walls of a wellbore 49. The system 100 includes an ESP 110, which comprises a pump 120, a motor protection component 130, and a motor component 140. A power connector 150 is also shown at the top of the motor component 140. The power connector 150 is attached to a power conduit cable 160, which runs up the side of the ESP 110 and continues up to the top of the wellbore 49 where it is coupled to an external power source. In other embodiments, other configurations of the various components of the ESP may also be used.

In an embodiment, the motor component 140 is at a bottom end of the ESP and a top end of the motor component 140 is coupled to a bottom end of the motor protection component 130. A top end of the motor protection component 130 is coupled to the pump 120.

An intake opening 125 is on the side of the pump 120 near the bottom end of the pump 120. Fluid from the wellbore 49 comes into the ESP from this intake opening 125 and is pumped through the pump 120 up and out of the wellbore 49 via the production tubing 170.

Figure 3A:
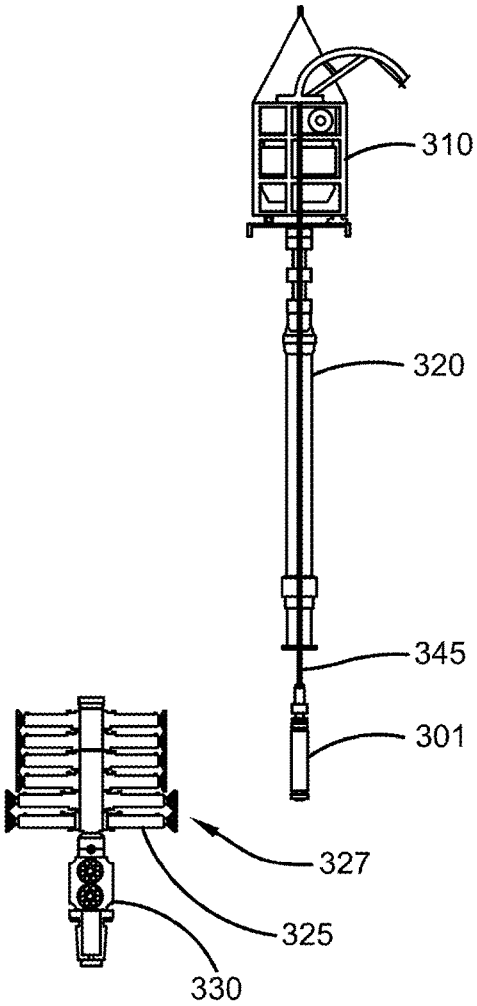
FIGS. 3A to 3C are side plan views of an exemplary cable deployed system including the ESP and other downhole components of the wellhead as they are installed into the wellbore.
Figure 3B:
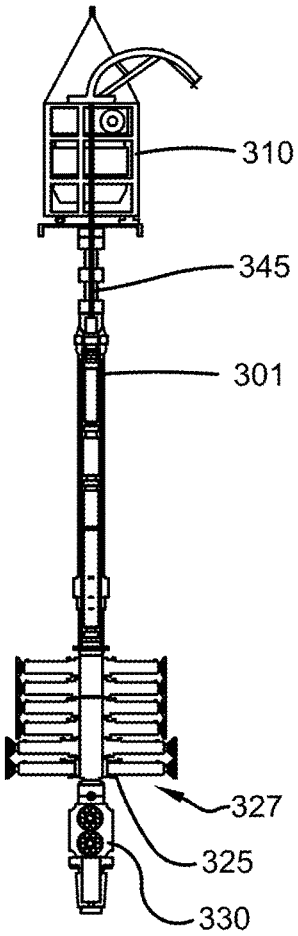
Figure 3C:
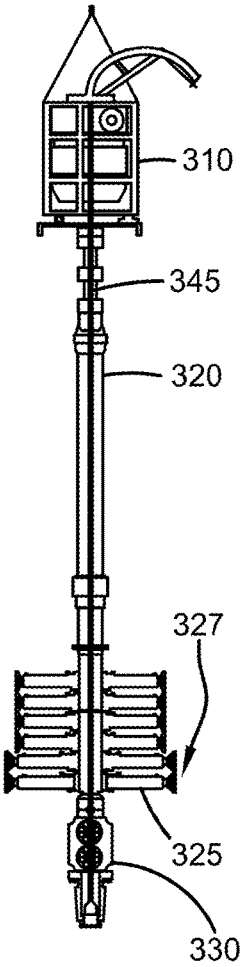

FIGS. 3A-3C show the system including the ESP 301 and other downhole components of the wellhead 327 and method as they are installed into the wellbore. In FIG. 3A, the cable 345 is advanced through the pressure containment equipment 310 and through the risers 320. The risers 320 are disconnected from the rest of the wellhead 327 to allow for the installation of the downhole components. The ESP 301 and other downhole components are then installed at the end of the cable 345 and the cable 345 and ESP 301 are retracted up into the risers 320. A crane moves the risers 320 over the wellhead 327. The bottom terminal end of the risers 320 is then locked into place onto the top of the BOP 325. (See FIG. 3B.) Then, the cable 345 is advanced downhole and the ESP 301 and other downhole equipment is dropped into the wellbore through the opened Christmas tree unit 330. (See FIG. 3C.) The ESP 301 may be dropped up to 15,000 ft, e.g., 2,000 to 10,000 ft, or 5,000 to 8,000 ft.

Figure 4C:
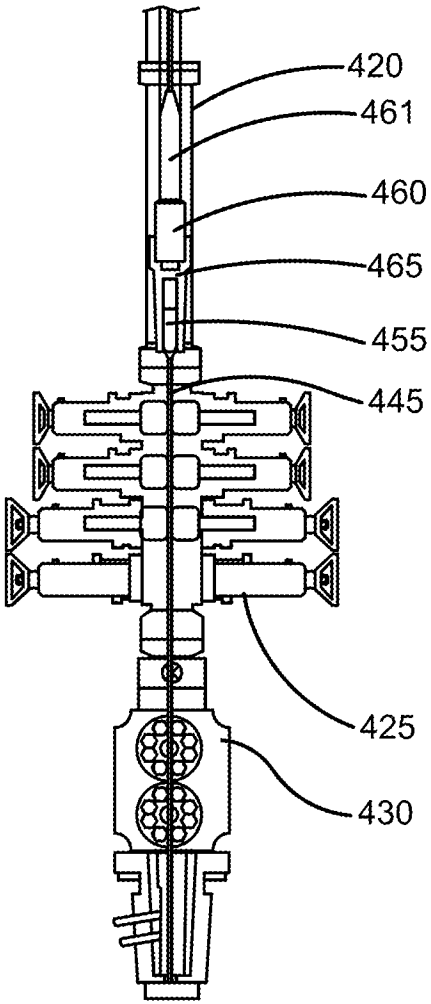
FIGS. 4A to 4C are side plan views illustrating an exemplary system showing the power cable termination after the ESP has reached the desired depth and the cable hanger installation.
Figure 4B:
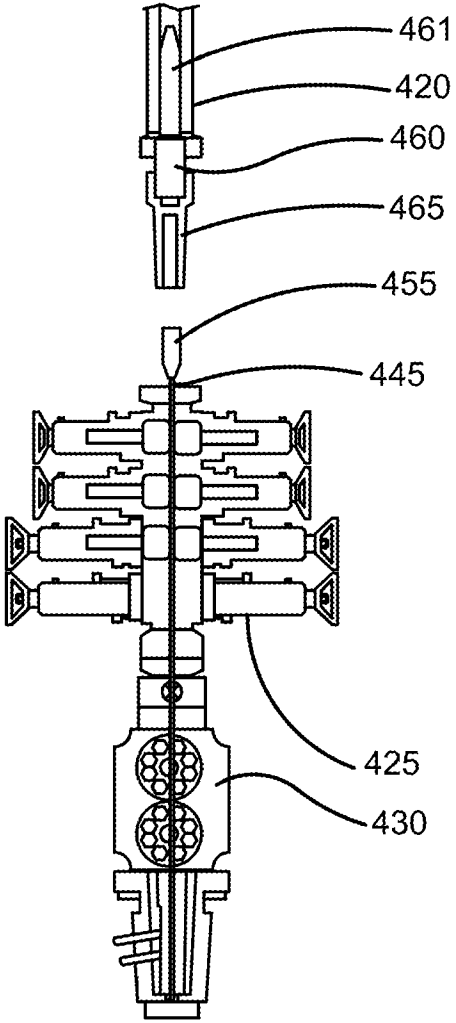
Figure 4A:
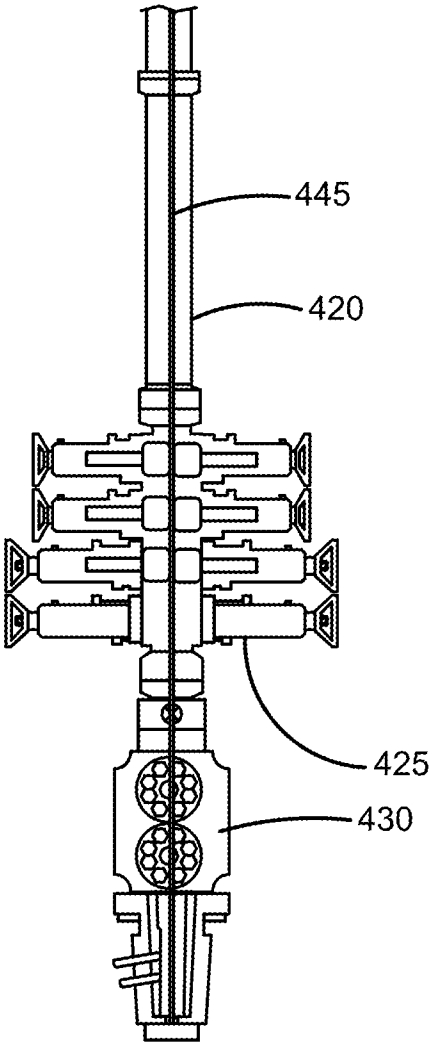

In FIGS. 4A to 4C, the cable termination and hanger installation are shown. The cable 445 is provided slack to a lesser weight, e.g., 2000 lbs. The cable 445 is picked up, e.g., 25 feet. The rams of the BOP 425 are then closed on the cable 445 holding it securely in place, sealing against well pressure, and pressure is bled from the system above the BOP 425.

FIG. 4B shows the wellbore stack in the next step with the risers 420 disconnected. The cable 445 is thus exposed and cut. A connector 455 is installed on the terminal end of the downhole portion of the cable 445. The jarring device 461 (discussed in more detail below) and the running/pulling tool 460 and hanger 365 are installed on the uphole portion of the cable 445. The lower portion of the running/pulling tool 460 is situated and locked inside the upper portion of the hanger 465 by dogs (See, e.g., FIG. 8, dogs 817).

As shown in FIG. 4C the connector 455 is then attached inside the bottom portion of the hanger 465, thereby recoupling the two previously cut ends of the cable. The risers 420 are then reconnected to the top of the BOP 425 closing the system. The pressure is equalized in the system and the rams of the BOP 425 are opened. The jarring device 461, running/pulling tool 460, hanger 465, and connector 455 are then dropped down through the BOP 425 and Christmas tree 430.

Figure 5:
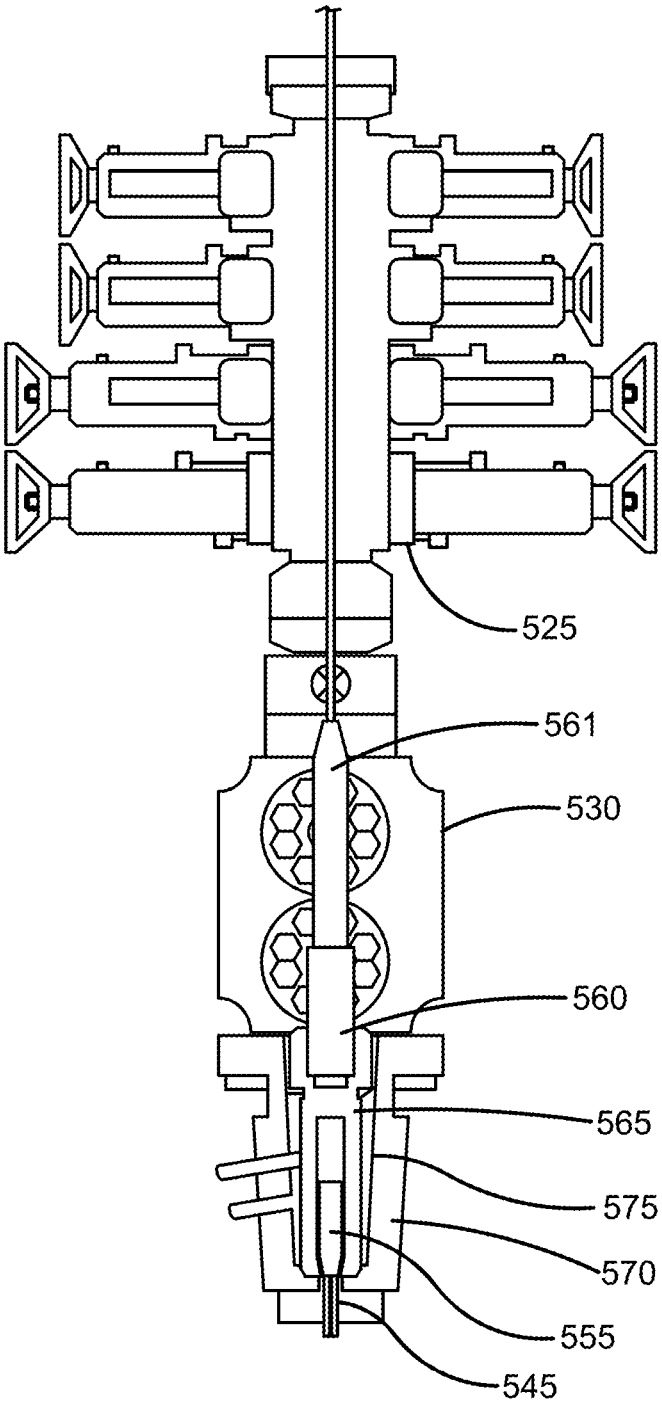
FIG. 5 is a side plan view showing an exemplary cable deployed system with a hanger seated inside the spool and connected to the power cable.

FIG. 5 shows the hanger 565 seated in the spool 570, coupled to a sleeve 575. The hanger 565 has a lip and a neck that allows it to be dropped into and seated in the spool without dropping into the wellbore. The connector 555 remains in the hanger holding the cable 545 as it extends downhole to the ESP. The running/pulling tool 560 is still connected to the hanger 565. The jarring device 561 is still coupled to the top of the running/pulling tool 560 and extends up into the Christmas tree, and in some embodiments could extend into the BOP 525 or even the risers.

Figure 6:
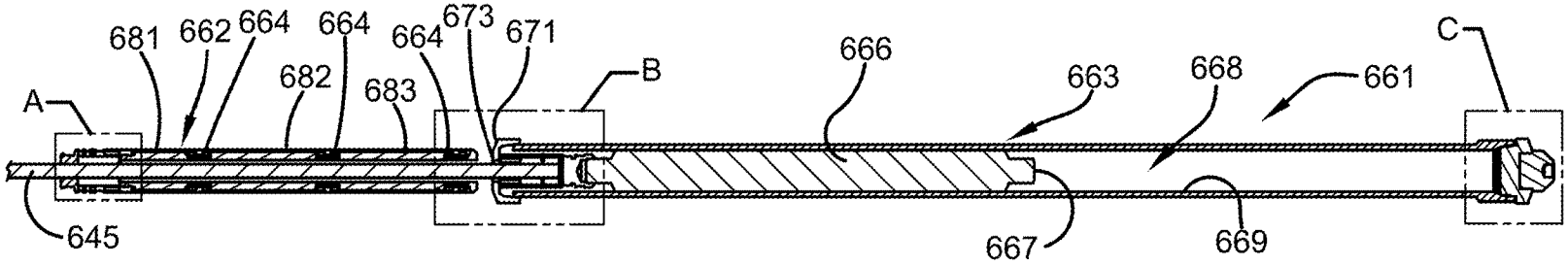
FIG. 6 is a cross-sectional view of an exemplary jarring device and cable.

FIG. 6 is a cross-sectional view of an example jarring device 661. The jarring device 661 comprises an upper weight section 662. The upper weight section 662 has a cable 645 running through it. In this example, the upper weight section 662 can be modular in split shell portions, over and around the cable 645, and each modular unit can be attached, in this case, with split clamps 664, which are clamped on to the side of the upper weight section 662. In this example there is a first modular weight section 681, a second modular weight section 682, and a third modular weight section 683. In this embodiment, each of these modular weight sections 681, 682, 683 includes two half-shells that are coupled together and to the module above and/or below using two split clamps 664 then bolted together. This mechanism allows quick addition or removal of weight and without having to tread anything over the cable 645. The only section of the modular weight that needs to be installed over the cable 645 in advance is the upper terminal lip end 706, which is used to latch inside the tool catcher via the lip 711 and has a minimal weight.

The first, second, and third modular weights 681, 682, 683 allow the technician to adjust the weight to deliver a precise jarring blow as needed to accommodate various situations encountered in the wellbore and with the existing equipment as discussed below. Each modular weight can be, for example, 10 to 100 lbs, such as 25 to 75 lbs, or 35 to 65 lbs.

The jarring device 661 also comprises a jar section 663 that has an interior hollow 668 bounded by circumferential walls 669. The jar section 663 may also be modular, meaning multiple sections can be connected together to increase or shorten the overall length as needed. In an example, the jar section 663 can be 10 ft commercial 3.5 in OD×10 ft @11.6 lb/ft production tubing pup joints and can be stacked together to increase or decrease the drop height as needed. These tubing pup joints can be purchased or rented commercially or borrowed if already on-site.

The cable 645 extends from the reel through the upper weight section 662 into the jar section 663. In alternate examples, another cable section could be coupled to the upper weight section 662 and not extend all the way through it.

In this embodiment the jar section 663 is generally in the form of a hollow cylinder with an upper end impact cap 671 and an adapter 743 (See FIG. 7C) with the upper end impact cap 671 having an upper hole opening 673 for the cable 645 to slide through. The cable 645 is coupled to a secondary weight 666 that is slidably disposed in the interior hollow 668 of the jar section 663, but restricted from sliding out of the jar section 663. The secondary weight 666 can also be modular as multiple weight bars can be connected together to increase or decrease the drop weight. The secondary weight 666 in this example has a bottom impact surface 667 at its lower terminal end.

Based on the configuration, the secondary weight 666 (and thus the height needed) can be increased to change the impact force. In an example, the secondary weight 666 is a commercial slickline stem bar or sinker bar, and in this example a 2.5" OD×5' @85 lbs Tungsten filled commercial sinker bar was used.

Figure 7A:
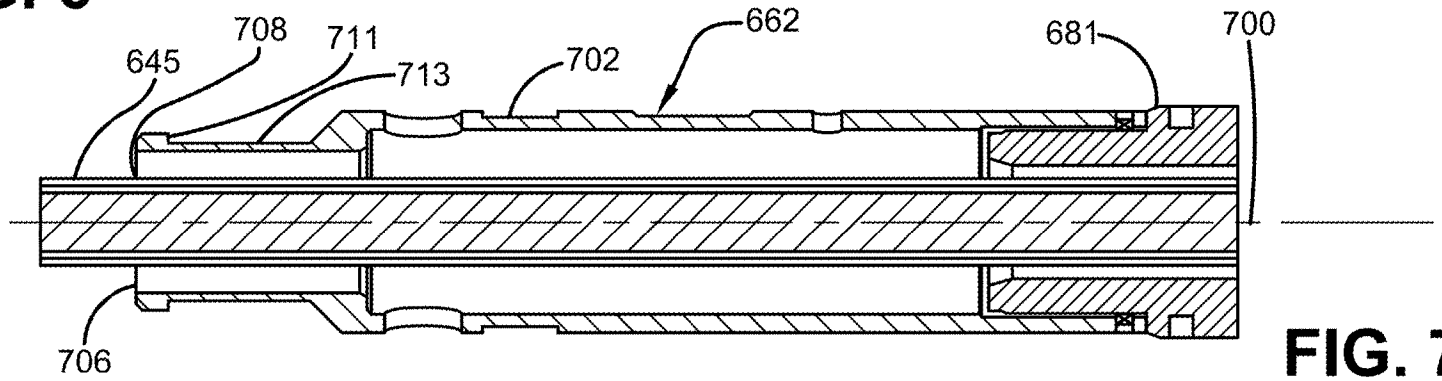
FIG. 7A is a cross-sectional detailed view of section A of the jarring device of FIG. 6.

FIG. 7A is a cross-sectional detailed view of section A of the jarring device 661 of FIG. 6. Section A is the upper terminal lip end 706 and the area near the upper terminal lip end 706 of the upper weight section 662 of the jarring device 661. The cable 645 passes through an upper opening 708 of the upper weight section 662 and extends along an axis 700. The upper terminal lip end 706 includes a lip 711 and a neck 713. The lip 711 is configured to be held by a tool catcher described below suspending from the top of the jar section 663.

The cable 645 is surrounded by inner walls of an upper bell housing 702 and then passes through inner walls of the first, second, and third modular weight sections 681, 682, 683. An inner diameter of the modular weight sections 681, 682, 683 may exceed the outer diameter of the cable 645 by, for example, 0.1 to 1 inch, such as 0.2 to 0.6 inches, or 0.3 inches. This difference is to allow the cable to 645 to freely move within the inner diameter of the modular weight sections 681, 682, 683 but act as a centralizing guide to ensure maximum impact energy upon weight release from the tool catcher. The first modular weight section 681 is secured into the upper bell housing 702, by, for example a matching screw-thread mechanism. The second modular 682 weight is secured into the first modular weight section 681 using two split clamps 664 that are bolted together via 4 bolts, as is the third modular weight section 683 secured into the second modular weight section 682. In other example fewer, e.g., 0, 1, or 2 modular weights can be installed, or more modular weights can be installed, e.g., 4 to 20, 5 to 12, or 6 to 10.

The upper weight section 662 is configured to slide in relation to the cable 645 and in relation to the jar section 663. The upper weight section 662 and the jar section 663 will be pulled upward when the cable 645 is retracted. See FIGS. 9A-10E for further movement characteristics.

Figure 7B:
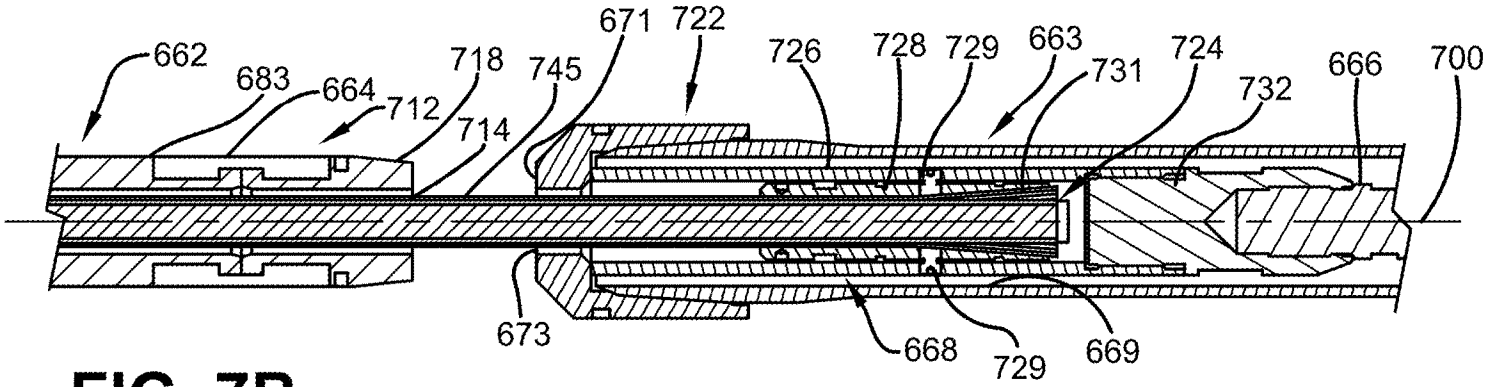
FIG. 7B is a cross-sectional detailed view of section B of the jarring device of FIG. 6.

FIG. 7B is a cross-sectional detailed view of section B of the jarring device 661 of FIG. 6. Section B shows the lower terminal end 712 of the upper weight section 662 and the upper terminal end 722 of the jar section 663. The cable 645 runs along the axis 700 through the third modular weight section 683 out of the lower opening 714 in the impact hammer end piece 718 of the upper weight section 662 and extends into the jar section 663. The impact hammer end piece 718 is secured into the third modular weight section 683, e.g., by split clamps 664. The impact hammer end piece 718 is a single piece and slides over the cable 645 prior to the cable termination. The upper opening 708 and lower opening 714 are centered around the axis 700 and inner walls define a housing running through the various sections between the openings.

The cable 645 terminates in the jar section 663 at a cable terminal assembly end 724. The cable terminal assembly end 724 includes dual armor locking cone-shaped wedges 731, themselves wedged inside the cable termination housing 728. The cable terminal assembly end 724 is mechanically installed and uses a triple one system to jam and lock the cable armor wires together. The upper terminal end 722 of the jar section 663 has an upper end impact cap 671 that is secured to the circumferential walls 669 of the jar section 663. The upper end impact cap 671 is configured to withstand the heavy impact of the impact hammer end piece 718 of the upper weight section 662; i.e., it is made of a suitably hard material, attached to the circumferential walls 669 of the jar section 663 with a robust coupling mechanism, and has a flat abutting surface dimensioned to match a flat abutting surface on the impact hammer end piece 718.

The cable termination housing 728 and cable terminal assembly end 724 is coupled to a sleeve 726 via two shear pins 729. The sleeve 726 has a greater diameter than the upper hole opening 673. One or more secondary shear pins 729 run through openings with matching diameters in the cable termination housing 728 and are threaded into sleeve 726 matching openings. The shear neck sits in the narrow opening between the sleeve 726 and the cable termination housing 728. The upper end of the lower adapter 732 is coupled into the sleeve 726, e.g., with matching screw threads. The lower end of the lower adapter 732 is coupled to the secondary weight(s) 666.

Accordingly, the sleeve 726, along with its coupled attachments (the secondary weight 666, the secondary shear pins 729, the cable 645, cone-shaped wedges 731, the cable termination housing 728, and lower adapter 732) is slidable within the interior hollow 668 of the jar section 663 bounded by the circumferential walls 669. The sleeve 726 has a larger circumference than the upper hole opening 673 and abuts an interior surface around the upper hole opening 673 when in an up position. The jar section 663 is configured to retain a terminal end of the cable 645 in the interior hollow 668. The sleeve 726 is shown in an up position.

In an embodiment, the secondary shear pins 729 have sufficient strength to exceed by a preset margin (e.g., exceed by at least 10%, at least 50% or at least 100%) the combined weights of the hanger, cable 645 at the ESP installation depth in the well, and the ESP, jarring device 661, running/pulling tool 560 and hanger 565, being dropped into place with the hanger 565 being seated and secured in the spool via locking bolts, as depicted in FIG. 5 without breaking. The shear strength of the secondary shear pins 729 is selected to break after the combined weight of the equipment below and a preselected safety margin (e.g., at least 10%, at least 50%, or at least 100%) are exceeded when pulling up on the cable against the hanger and running/pulling tool locking mechanism depicted in FIGS. 10A-10E. In an example, the shear pin 729 can have a tensile strength of 6,000 lbs each, or in an example 2,000 to 10,000 lbs or 3,000 to 8,000 lbs or 4,000 to 6,000 lbs. In an embodiment, the secondary shear pins 729 are two pins that each have a shear strength of 2,000 lbs to 10,000 lbs.

Figure 7C:
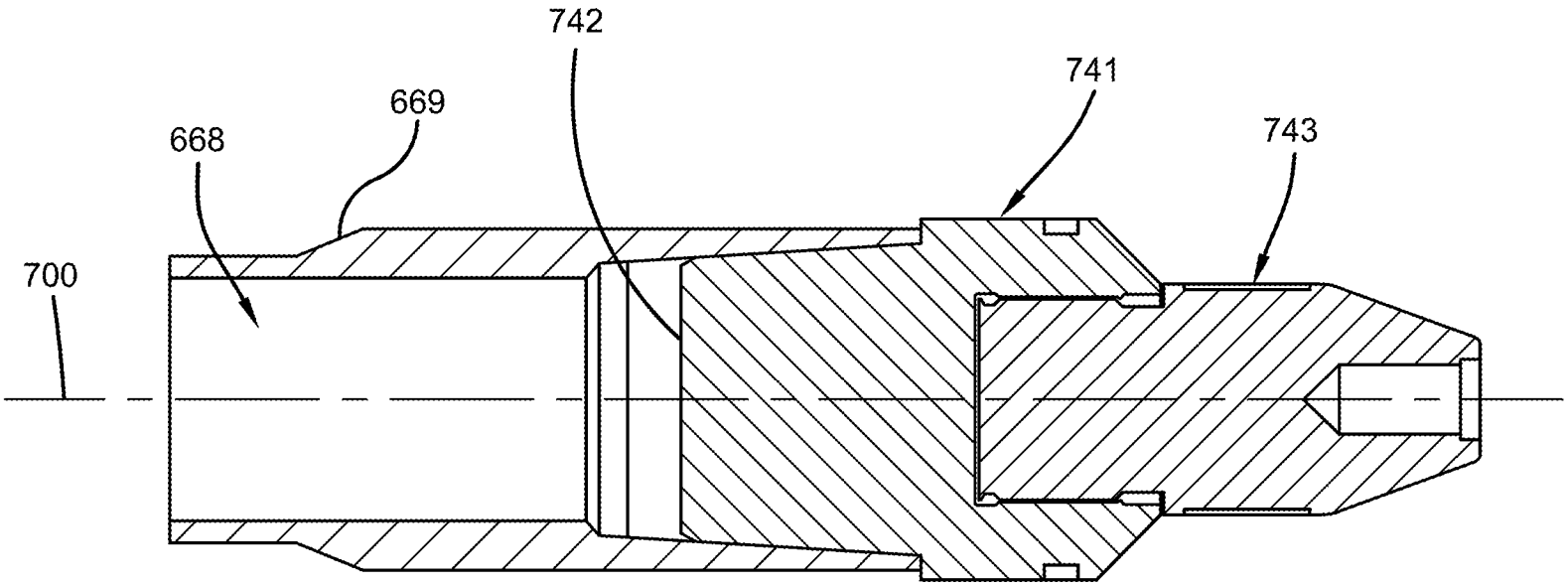
FIG. 7C is a cross-sectional detailed view of section C of the jarring device of FIG. 6.

FIG. 7C is a cross-sectional detailed view of section C of the jarring device 661 of FIG. 6. Section C is the lower terminal end of the jar section 663 and the jarring device 661. The lower impact end cap 741 is securely coupled into the circumferential walls 669 (e.g., by matching screw threads). The lower impact end cap 741 has secured into it on its bottom an adapter 743, which is configured to connect to components such as the alignment tool 807 and the running/pulling tool 860 attached to the hanger 865 and thus impart the drop weight down impact to the primary shear pin 816 inside the running/pulling tool 860.

The lower impact end cap 741 terminates the bottom end of the interior hollow 668 and has a flat surface facing the interior hollow 668 and is configured to withstand the impact of the bottom impact surface 667 of the secondary weight 666 in the secondary jarring operation depicted in FIGS. 10A-10E.

The secondary weight 666 can be for example 100 lbs, or, in an example, 25 to 300 lbs, 50 to 200 lbs, or 75 to 150 lbs. The distance between the bottom impact surface 667 of the secondary weight 666 in its uppermost position and the bottom of the interior hollow 742 may be, for example, 1 to 20 feet, such as, 2 to 10 feet, or 3 to 5 feet.

Figure 8:
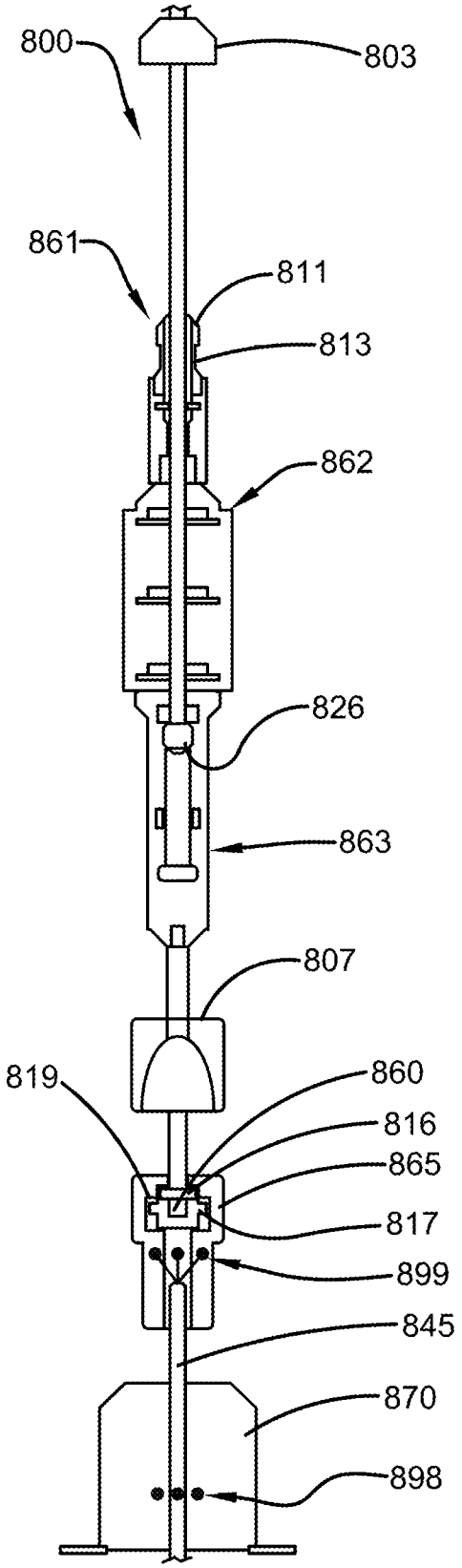
FIG. 8 is a schematic of an exemplary system for deploying a cable hanger system using a running/pulling tool.

FIG. 8 is a schematic of a system 800 for removing a running/pulling tool. The system 800 including an example of a jarring device 861. The jarring device 861 is a simpler version of the example jarring device 661 of FIGS. 6-7C in that it does not contain a secondary weight 666.

The system 800 also comprises a tool catcher 803 at the top of the exposed cable 845. The tool catcher 803 would typically be attached near the top of pressure control equipment, and, in turn, attached to the coiled tubing injector head, and held in place by a crane. The tool catcher 803 is configured with a vertical pass-through hole for the cable 845 to pass-through and a catching mechanism to catch and hold the top of the jarring device 861. In an example, the tool catcher 803 includes spring loaded and hydraulically opened fingers or some other catching mechanism that catch underneath a lip 811 of the jarring device 861, optionally contacting a neck 813 portion of the upper weight section 862. The tool catcher 803 is controlled to catch and release, e.g., by hydraulics.

The tool catcher 803 can also be used as a security measure to catch a tool being retrieved with the cable and in the event the cable is accidentally disconnected from it when the cable pulling mechanism fails to stop when the tool head reaches the catcher.

The system 800 also includes an alignment tool 807 that is configured to correctly orient the hanger 865 and the spool 870 electrical connections. In this embodiment impact will be transferred through the jarring device 861 to the running/pulling tool 860 via the alignment tool 807. It should be noted that the alignment tool is an optional component of the systems disclosed herein and is used in conjunction with the specific hanger and spool being used.

The system 800 also includes a hanger 865 with electrical connections 899. When installed properly the electrical connections 899 on the hanger 865 will match and contact with matching electrical connections 898 on the spool 870 electrically coupling the hanger 865 (which is coupled to the cable 845 the cable coupled to ESP) to the spool 870 (which is coupled to the power source).

The running/pulling tool 860 is retained by the internal neck of the cavity 819 of the hanger 865 by dogs 817, which allow insertion of the hanger via a downward motion, but not retraction via an upward motion. The running/pulling tool 860 includes primary shear pin 816 which when broken by a sufficient down jarring force causes the dogs 817 to retract, thereby allowing the running/pulling tool to be removed from the wellbore assembly. The shear pin 816 seating inside the running/pulling tool 860 is configured such that the shear pin 816 can only be sheared by a down impact and not an upwards impact or over-pull.

FIGS. 9A-9D illustrate the operation of the system 800. It should be understood that what is depicted is in actuality covered and encased by the BOP, risers and Christmas tree (See FIG. 4A), and depending on particular well conditions, may be surrounded by wellbore fluid(s) in the operations disclosed in FIGS. 9A-9D and also FIGS. 10A-10E.

Figure 9D:
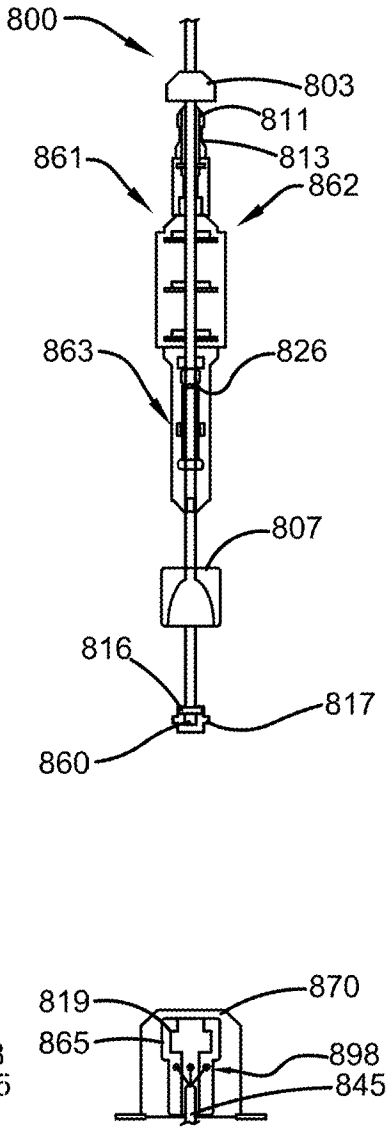
FIGS. 9A-9D are schematic illustrations of the operation of the exemplary jarring device and system.
Figure 9C:
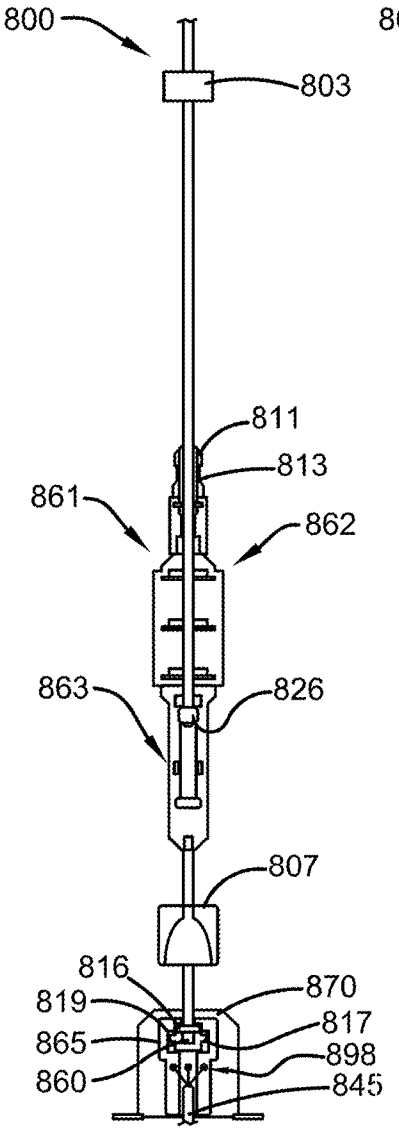
Figure 9B:
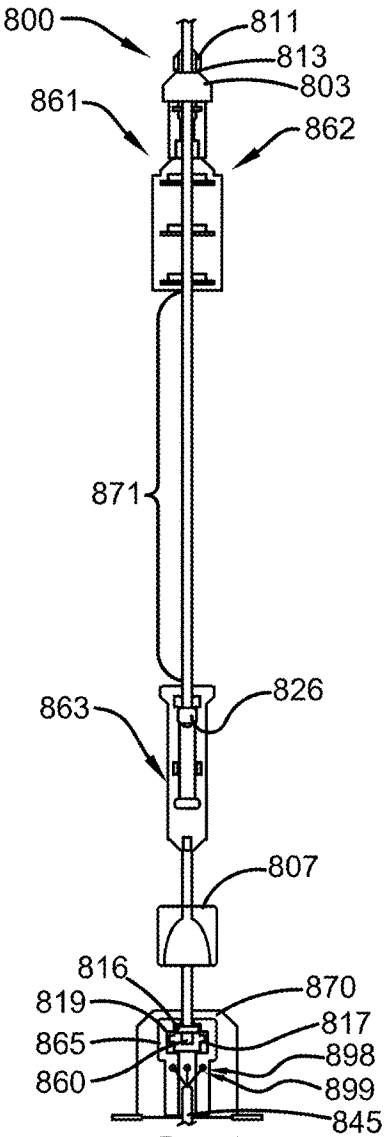
Figure 9A:
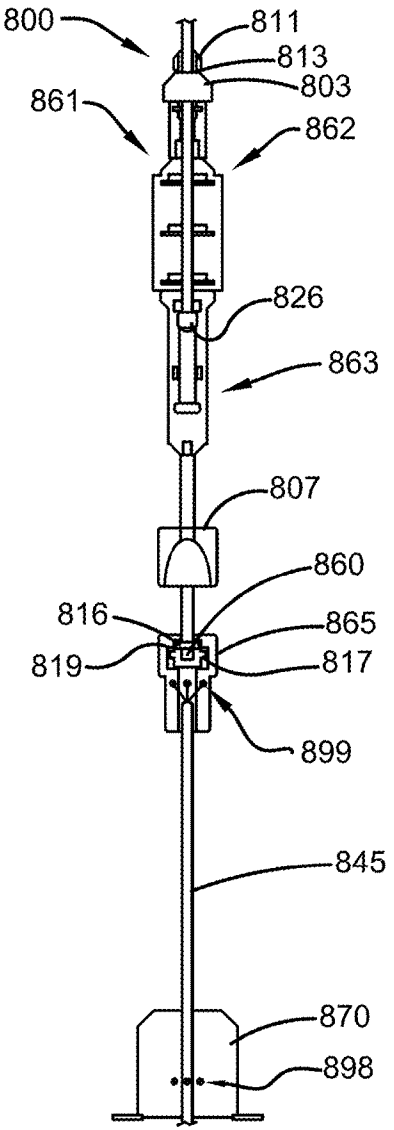

First, in FIG. 9A, the cable 845 along with the entire assembly is pulled up until the lip 811 and neck 813 of the upper weight section 862 are in the tool catcher 803. The upper weight section 862, e.g., the lip 811 and/or neck 813 of the upper weight section 862 are grasped and held by fingers located inside of the tool catcher 803.

Next, in FIG. 9B, the cable 845 is advanced downhole causing the jar section 863, alignment tool 807, running/pulling tool 860, and hanger 865 attached to the cable 845 to drop. The hanger 865 is thus dropped into the spool 870. In an example, the hanger 865 may drop 35 feet into the spool 870 in this step, in other examples, 10 to 100 feet, 20 to 60 feet, or 25 to 50 feet.

In FIG. 9C, after providing some slack to the cable by advancing it down. This small slack releases all upwards loading applied to the running/pulling tool 860 locked inside the hanger 865, thus allowing full effectiveness of the impact energy when the weight is dropped. In FIG. 9C the tool catcher 803 releases or drops the upper weight section 862 and guided by the cable 845 it accelerates in the well fluid (or air) in the drop distance 871 until it rams into the top surface of the jar section 863. This forces the jar section 863 and alignment tool down 807 onto the running/pulling tool 860. This force is born by the primary shear pin 816, which if done correctly causes the primary shear pin 816 to shear on both sides. When the primary shear pin breaks, it releases the dogs 817, causing them to retract, thereby freeing the running/pulling tool 860 from the hanger 865.

Jarring the running/pulling tool 860 with sufficient force to break the primary shear pin 816 of the running/pulling tool 860 without damaging the spool 870, hanger 865, or electrical connections 899 or matching electrical connections 898 is a somewhat delicate operation and can be complicated by variations in the fluid in the well, the material of the primary shear pin 816, the height of the drop distance 871, and weight of the upper weight section 862. The drop distance being a distance between a bottom of the upper weight section 862 and a top of the jar section 863. The drop distance may be, for example, 10 to 60 ft, or 20 to 50 ft, or 30 to 40 ft.

In FIG. 9D, the running/pulling tool 860 is pulled back up above the Christmas tree, leaving the hanger 865 seated in the spool 870. After successfully testing the electrical connections 898, 899, the system 800 can then be depressurized and drained. The riser can be disconnected and the running/pulling tool 860 along with the jarring device 861 and alignment tool 807 can be removed from the system 800. Throughout the jarring operation, the jarring device 861, the alignment tool 807 and the running/pulling tool 860 remain connected. The well is then secured from top at the Christmas tree and the complete surface set-up, such as risers, BOP's, other pressure control accessories, coiled tubing injector head, the coiled tubing unit with the remainder of the cable 845 on the reel, can also be removed from the well site and sent back to base or to another similar operation system 800. Then the well is ready for production and the ESP can be powered-up via the VSD or surface power unit for long term production and the well is released to the production department of the operating company.

In some instances, the primary shear pin 816 does not break with the impact of the released primary weight. This can occur due to faulty calculations or unexpected conditions in the wellbore fluid or defective materials. If this happens, it typically requires resetting the whole system 800, involving depressurizing and replacing the entire system 800 to inspect, remedy the issue, and re-latch the jarring device 861 in the tool catcher 803. This is time consuming and expensive to do.

Another example system 901 is disclosed in FIGS. 10A-10E, which allows for a second chance at jarring and breaking the primary shear pin 816. This system 901 uses a version of the jarring device 961 of FIG. 6 and FIGS. 7A-7C. FIGS. 10A-10E depict the jarring device 961 in simplified schematic form.

Figures 10A, 10B, 10C, 10D:
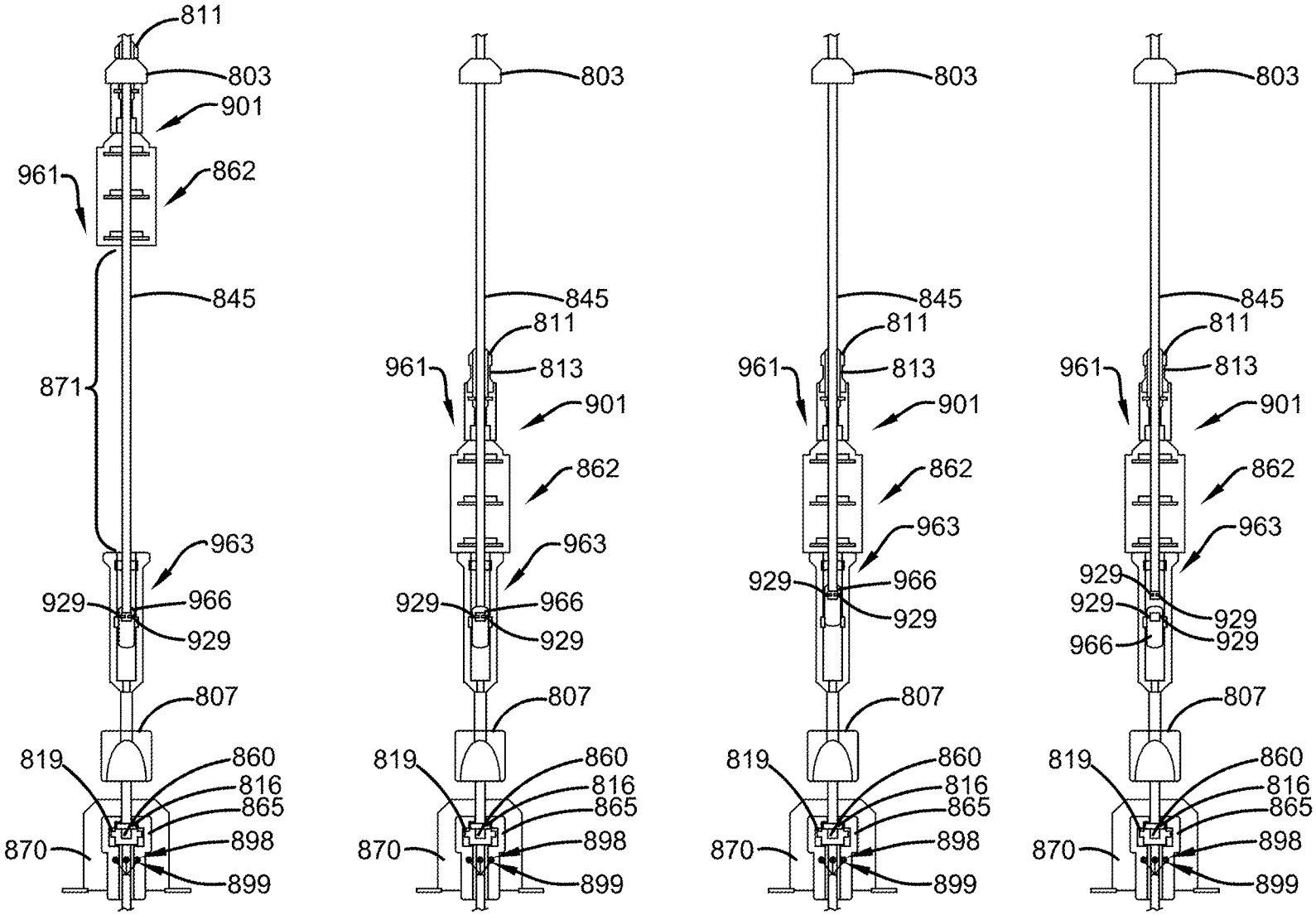
FIGS. 10A-10E are schematic illustrations of the operation of another exemplary jarring device and system.
Figure 10E:
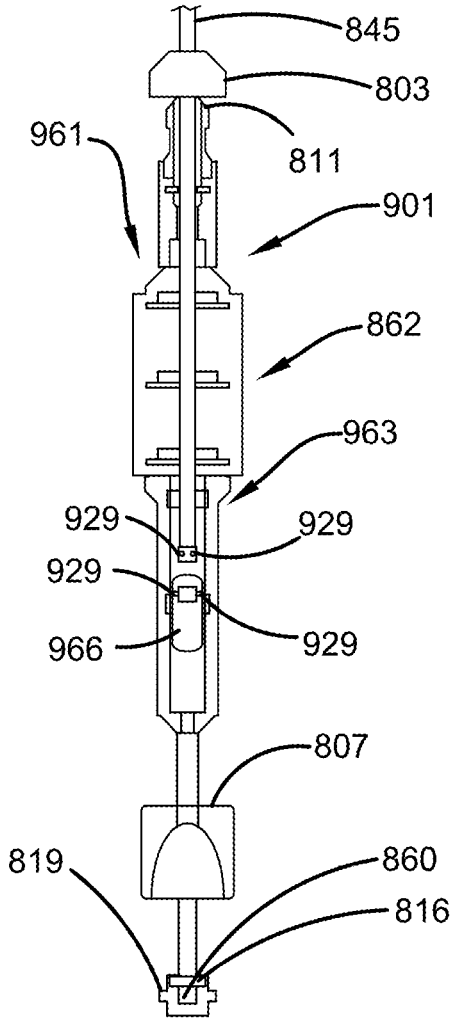
Figure 10E:
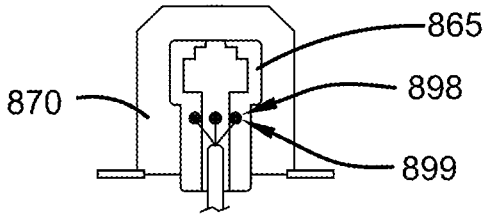

In FIG. 10A, the upper weight section 862 is the same as in FIG. 8 and FIGS. 9A-9D. The jar section 963 differs, however, in that it includes a secondary weight 966 and secondary shear pins 729 that are coupled to a surface in the interior of the jar section 963. (For example, this coupling can be via the sleeve 726 and the cable termination housing 728 as shown in FIG. 7B.)

The position of the system 901 shown in FIG. 10A matches the position of FIG. 9B, wherein the upper weight section 862 is grasped in the tool catcher 803, and the cable 845 has been advanced downhole causing the jar section 963, alignment tool 807, running/pulling tool 860, and hanger 865 to drop into place. Notably, here, in contrary to FIG. 9A the upper weight section 862 may be installed initially grasped by the tool catcher 803, so that the upward pulling of the entire assembly is not required. The cable 845 is also advanced downhole to provide the slack to achieve the same loading relief from the running/pulling tool dogs 817 prior to dropping the upper weight section 862.

Similar to the operation in FIG. 9B, in FIG. 10B, the tool catcher 803 releases the upper weight section 862 and it accelerates down in the well fluid or air guided by the cable 845 until it rams into the top surface of the jar section 963. This forces the jar section 963 and alignment tool down 807 onto the running/pulling tool 860. This force is born by the primary shear pin 816, which if done correctly causes the primary shear pin 816 to break.

While this operation is designed to result in breakage of the primary shear pin 816; in contrast to the operation in FIG. 9B, FIG. 10B illustrates the situation when the primary shear pin 816 does not break, or only partially breaks, and dogs 817 are not released. Thus, the running/pulling tool 860 is not released.

Instead of having to reset the entire system 901, the secondary weight 966 can instead be activated to provide a secondary jarring force to provide the operator a second chance at fully and effectively breaking the primary shear pin 816.

FIG. 10C shows the first step in secondary jarring operation, wherein the cable 845, which is coupled to the secondary weight 966 in the jar section 963, is slowly pulled up and the secondary weight 966 also moves up in the jar section 963. The secondary shear pin 929 may also be coupled between the cable 845 and the secondary weight 966. This causes the secondary shear pin 929 to contact a downward facing surface of the jar section 963 stopping the upward motion of the secondary weight 966 (e.g., by way of its coupling to a sleeve (726 FIG. 7B). As the upwards pull on the cable 845 slowly continues, the force in the cable 845 is transferred to cable termination housing 728 and then onto the sleeve 726 coupled to the secondary weight 966 via the two secondary shear pins 729. The jar section 963 and alignment tool 807 cannot move up due to the primary shear pin 816 securing the hanger 865 to the spool 870. The shearing force continues to slowly increase until it exceeds the preset strength of the secondary shearing pins 729.

As shown in FIG. 10D, the secondary shear pin 929 breaks, and the secondary weight 966 is released (decoupled) from its coupling to the cable 845, allowing it to drop a distance inside the jar section 963 ramming the interior bottom surface of the jar section 963 with a secondary impact force. This drop distance in the jar section may be, for example, 14 ft or as per design requirements, for example, 8 ft to 24 ft, or 10 ft to 20 ft, and the weight can be 100 lbs or 100 to 200 lbs or 150 to 300 lbs. This results in a secondary impact force that is transferred from the interior bottom surface of jar section 963 to the alignment tool 807, a top surface of the running/pulling tool 860, and eventually to the primary shear pin 816 that is potentially already partially sheared from the first impact.

When the primary shear pin 816 breaks, it releases the dogs 817, causing them to retract, thereby freeing the running/pulling tool 860 from the hanger 865, allowing it to be retracted up by the cable 845.

In FIG. 10D, the running/pulling tool 860 is pulled back up above the Christmas tree, leaving the hanger 865 seated in the spool 870. After successfully testing the electrical connections 898, 899, the system 901 can then be depressurized and drained. The riser can be disconnected and the running/pulling tool 860 along with the jarring device 961 and alignment tool 807 can be removed from the system 800. The well is then secured from the top of the Christmas tree and the complete surface set-up such as risers, BOP's, other pressure control accessories, coiled tubing injector head, the coiled tubing unit with the remainder of the cable on the reel, can also be removed from the well site and sent back to base or to another similar operation. Then the well is ready for production and the ESP can be powered-up via the VSD or surface power unit for long term production.

Figure 11:
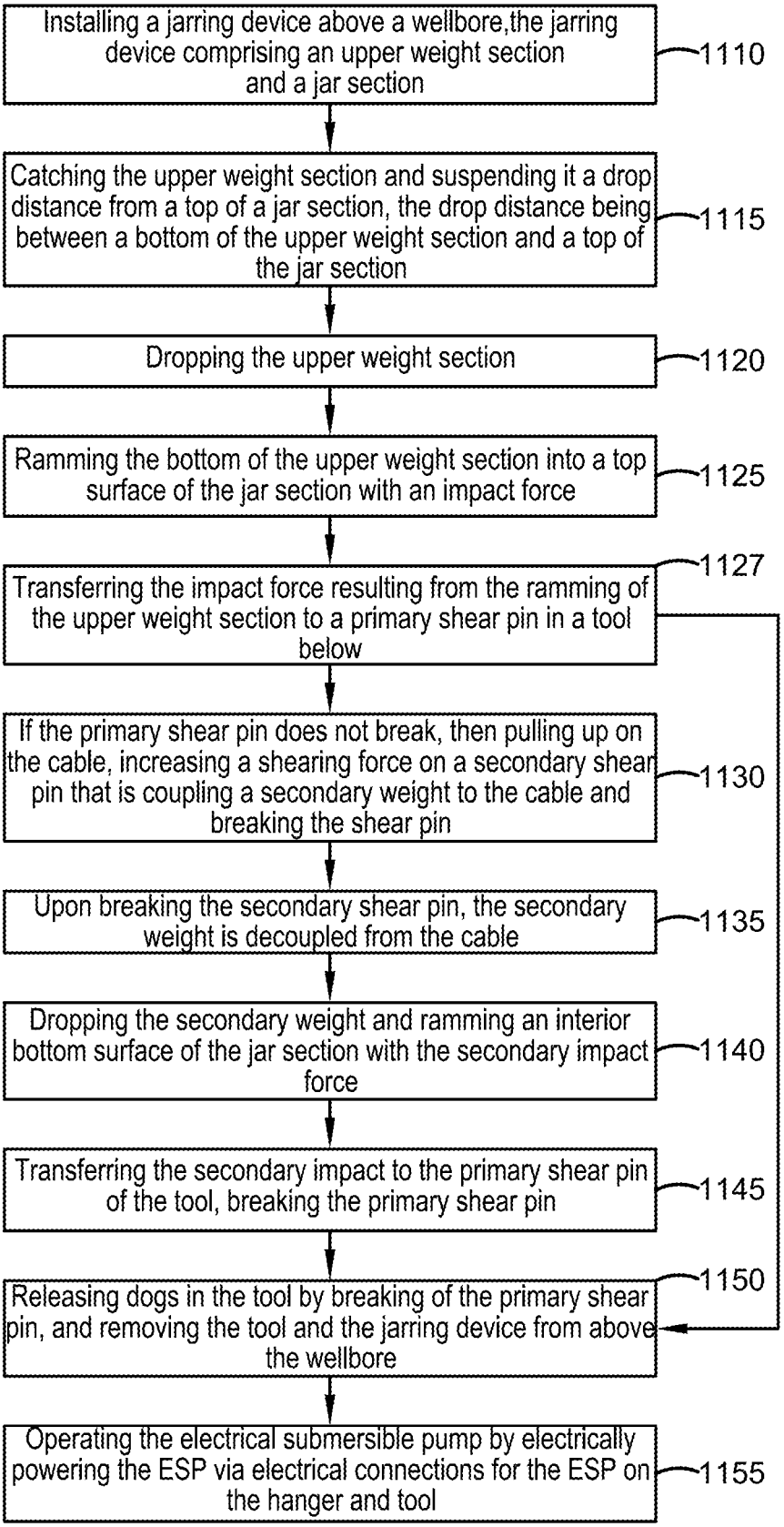
FIG. 11 is a flowchart of an example method for installing and operating an electrical submersible pump system in a wellbore.

FIG. 11 presents a simplified flowchart of an example method for installing and operating an electrical submersible pump system in a wellbore using a cable deployed system for conveyance. It focuses surface power cable landing mechanism release process from the electrical submersible system installed in the well.

At step 1110, a jarring device is installed on a cable above the wellbore, the jarring device comprising an upper weight section and a jar section.

At step 1115, the upper weight section is caught and suspended at a drop distance from a top of the jar section, the drop distance being between a bottom of the upper weight section and a top of the jar section.

At step 1120, the upper weight section is released from the tool catcher and dropped. At step 1125 a bottom of the upper weight section is rammed into a top surface of the jar section with an impact force.

At step 1127, the impact force resulting from the ramming of the upper weight section is transferred to a primary shear pin in a tool below.

If the primary shear pin breaks from the impact force resulting from the ramming of the upper weight section, then the method proceeds to step 1150. If the primary shear pin does not break, then at step 1130, the cable is pulled upward, increasing a shearing force on a secondary shear pin that is coupling a secondary weight to the cable and breaking the secondary shear pin.

At step 1135, upon breaking the secondary shear pin, the secondary weight is decoupled from the cable.

At step 1140, the secondary weight is dropped and it rams into an interior bottom surface of the jar section with a secondary impact force.

At step 1145, the secondary impact is transferred to the primary shear pin of the tool, breaking the primary shear pin.

At step 1150, dogs coupled to the primary shear pin in the tool are released by the breaking of the primary shear pin (whether by the initial impact of the upper weight section or by the impact from the secondary weight), and the tool and the jarring device are removed from above the wellbore.

At step 1155, the electrical submersible pump is operated by electrically powering the ESP via electrical connections for the ESP on the hanger and spool. In an additional step, the same jarring device and tool now removed from the wellhead assembly can be iteratively used in another wellhead assembly employing the same or similar operation.

In an exemplary method for operating an electric submersible pump system in a wellbore, a motor component for driving a pump is electrically signaled to start. Electric power is supplied and the motor turns, thereby turning the shaft and the pump impellers. Wellbore fluid is flowed into the ESP and oil in the motor component heats up due to friction and movement of parts in the motor. This causes the oil to expand into an oil chamber of a motor protection component. The wellbore fluid is pumped up and out of the wellbore in continuous operation.

In a method of servicing the ESP 110, the motor component 140 driving the pump 120 is shut down and pulled up from the wellbore 49. The motor protection component 130, motor component 140 and pump 120 could also be inspected and serviced if needed at this time. Oil quality and volume can be inspected and the oil can be changed as well. The assembled ESP 110 is then inserted back into the wellbore 49, and, the systems and methods disclosed in FIGS. 9A-9D or FIGS. 10A-10E can be utilized to properly attach the hanger to the spool and couple the electrical connections. Once the hanger is properly seated and connected and the jarring device and running/pulling tool is removed, the motor component 140 driving the pump 120 is restarted and production of hydrocarbons from the well can be resumed.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the details description or the claims, such term is intended to be inclusive in a manner similar to the term "comprising" as "comprising" is interpreted when employed as a transitional word in a claim. The term "consisting essentially" as used herein means the specified materials or steps and those that do not materially affect the basic and novel characteristics of the material or method. If not specified above, the properties mentioned herein may be determined by applicable ASTM standards, or if an ASTM standard does not exist for the property, the most commonly used standard known by those of skill in the art may be used. The articles "a," "an," and "the," should be interpreted to mean "one or more" unless the context indicates the contrary.

What is claimed is:

1. A jarring device for installing an electrical submersible pump system in a wellbore, comprising:

an upper weight section, the upper weight section comprising an upper opening and a lower opening centered around an axis, and inner walls defining a housing between the upper and lower openings; and a jar section, the jar section comprising an upper hole opening and configured to retain a terminal end of a cable in an interior hollow;

a sleeve configured to surround a cable terminal end of the cable, the sleeve being slidable to an up and down position in the interior hollow of the jar section, wherein the sleeve has a larger circumference than the upper hole opening and abuts an interior surface of the interior hollow around the upper hole opening when in an up position;

the upper weight section is configured to slide in relation to the cable and in relation to the jar section;

wherein the cable extends through the upper opening in the upper weight section.

2. The jarring device of claim 1, wherein the upper weight section comprises a first modular weight section and a second modular weight section.

3. The jarring device of claim 1, further comprising a secondary shear pin coupled to the sleeve, wherein the sleeve is coupled to a secondary weight within the interior hollow, which upon the secondary shear pin breaking causes the secondary weight to drop.

4. The jarring device of claim 3, wherein the secondary weight is of sufficient weight to break a primary shear pin in a running/pulling tool under the jarring device, thereby causing dogs of the running/pulling tool to release.

5. The jarring device of claim 3, wherein the secondary shear pin includes two pins that each have a shear strength of 2,000 lbs to 10,000 lbs.

6. The jarring device of claim 1, wherein the jar section includes a secondary weight in the interior hollow coupled to the cable via a secondary shear pin, the secondary shear pin configured to break upon the cable being pulled up with sufficient force.

7. A method of installing an electrical submersible pump system in a wellbore, the method comprising:

installing a jarring device on a cable above the wellbore, the jarring device comprising an upper weight section and a jar section;

catching the upper weight section and suspending it a drop distance from a top of the jar section, the drop distance being between a bottom of the upper weight section and a top of the jar section;

dropping the upper weight section; and ramming a bottom of the upper weight section into a top surface of the jar section with an impact force;

wherein the impact force resulting from the ramming of the upper weight section is transferred to a primary shear pin in a tool below.

8. The method of claim 7, wherein if the primary shear pin does not break, then pulling up on the cable, increasing a shearing force on a secondary shear pin that is coupling a secondary weight to the cable, and breaking the secondary shear pin;

upon breaking the secondary shear pin, the secondary weight is decoupled from the cable, dropping the secondary weight and ramming an interior bottom surface of the jar section with a secondary impact force.

9. The method of claim 8, wherein the secondary impact is transferred to the primary shear pin of the tool, breaking the primary shear pin.

10. The method of claim 9, wherein dogs of the tool are released by the breaking of the primary shear pin, and removing the tool and the jarring device from above the wellbore.

11. The method of claim 7, wherein a sleeve coupled to the cable is slidable to an up and down position in an interior hollow of the jar section, and the cable is coupled to a secondary shear pin through the sleeve.

12. The method of claim 11, wherein the sleeve has a larger circumference than an upper hole opening of the jar section and the sleeve abuts an interior surface of the upper hole opening when in an up position.

13. The method of claim 7, wherein the cable includes a power core protected by armor.

14. The method of claim 7, further comprising adjusting a weight of the upper weight section to be sufficient for breaking the primary shear pin by clamping a modular section to the upper weight section.

15. The method of claim 7, further comprising electrically coupling electrical connections for the electrical submersible pump on a hanger and a spool.

16. A system for installing an electrical submersible pump in a wellbore with a cable, the system comprising:

a tool catcher positioned above the wellbore;

a jarring device comprising:

an upper weight section, the upper weight section comprising an upper opening and a lower opening centered around an axis, and inner walls defining a housing between the upper and lower openings; and a jar section, the jar section comprising an upper hole opening and configured to retain a terminal end of the cable in an interior hollow;

the upper weight section is configured to slide in relation to the cable and in relation to the jar section;

a hanger positioned below the jarring device;

a spool retaining the hanger;

an electrical submersible pump disposed in the wellbore electrically coupled to the hanger via a downhole cable section;

the hanger electrically coupled to electrical connections in the spool.

17. The system of claim 16, wherein the electric submersible pump comprises:

a pump;

a motor protection component having an oil chamber and a wellbore fluid chamber;

a motor component, the motor component comprising oil and being fluidly coupled to the oil chamber of the motor protection component; and wherein the pump is configured to be driven by the motor component.

18. The system of claim 16, wherein the cable includes a power wireline inside tubing and the cable has an outer diameter of 0.5 to 2 inches.

19. The system of claim 16, wherein the jar section includes a secondary weight in the interior hollow coupled to the cable via a secondary shear pin, the secondary shear pin configured to break upon the cable being pulled up with sufficient force.

* * * * *